US012624838B2

(12) United States Patent
Yantis

(10) Patent No.: US 12,624,838 B2
(45) Date of Patent: May 12, 2026

(54) BRACE FOR AN OVEN APPLIANCE

(71) Applicant: Haier US Appliance Solutions, Inc., Wilmington, DE (US)

(72) Inventor: John Adam Yantis, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 384 days.

(21) Appl. No.: 18/302,468

(22) Filed: Apr. 18, 2023

(65) Prior Publication Data

US 2024/0353111 A1 Oct. 24, 2024

(51) Int. Cl.
*F24C 3/12* (2006.01)

(52) U.S. Cl.
CPC ..... *F24C 3/124* (2013.01); *F24C 3/126* (2013.01)

(58) Field of Classification Search
CPC ..... F24C 15/08; F24C 3/124; F24C 3/126; F24C 3/128; D06F 34/34; D06F 39/12
See application file for complete search history.

(56) References Cited

U.S. PATENT DOCUMENTS

| | | | | |
|---|---|---|---|---|
| 2,453,832 | A | 11/1948 | Dadson | |
| 2,556,554 | A | 6/1951 | Pellegrin | |
| 2,649,531 | A | 8/1953 | Woodburn | |
| 3,040,733 | A | 6/1962 | Sherman | |
| 3,253,874 | A * | 5/1966 | Czech | D06F 39/12 312/265.5 |
| 9,982,894 | B1 * | 5/2018 | Philip | F16B 5/0208 |
| 2015/0101837 | A1 * | 4/2015 | Evangelista | H02G 15/113 29/525 |

OTHER PUBLICATIONS

Whirlpool service manual for W11174814 dated Jun. 3, 2019. Retrieved from https://www.whirlpool.com/content/dam/global/documents/201906/service-manual-w11174814-range.pdf on Oct. 29, 2025 (Year: 2019).*

* cited by examiner

*Primary Examiner* — Allen R. B. Schult
*Assistant Examiner* — Amy E Carter
(74) *Attorney, Agent, or Firm* — Dority & Manning, P.A.

(57) ABSTRACT

An oven appliance may include a cabinet that defines a top side and a back side. In addition, the oven appliance may include a control assembly that may be positioned at the top side and the back side of the cabinet. Further, the oven appliance may include a rear wire cover connected to the control assembly. In addition, the oven appliance may include a control bracket attached to the control assembly, the control bracket comprising a brace.

16 Claims, 9 Drawing Sheets

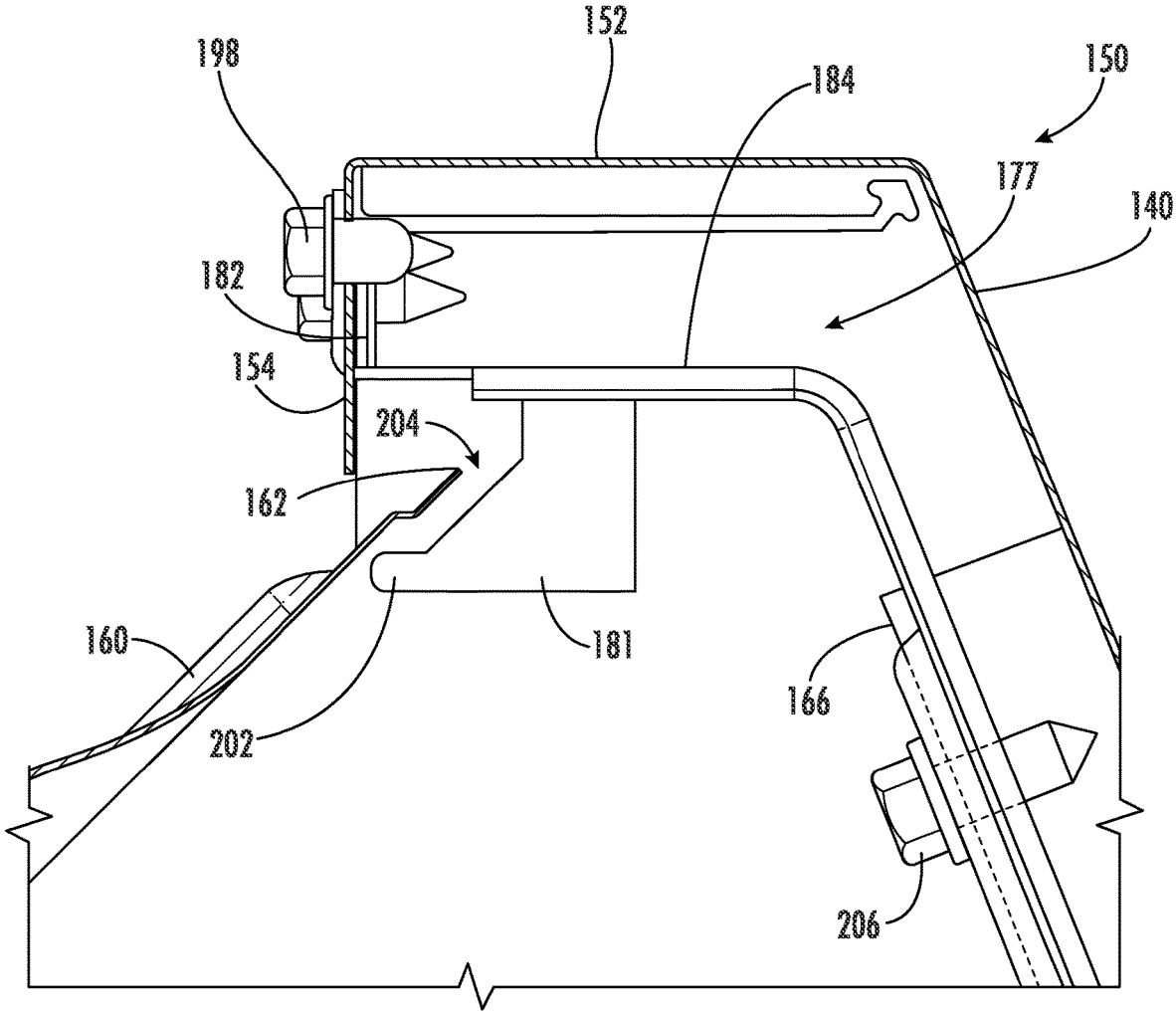
FIG. 7
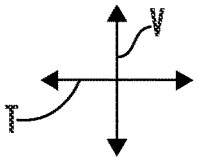

BRACE FOR AN OVEN APPLIANCE

FIELD

The present subject matter relates generally to oven appliances, and more particularly, to braces for oven appliances.

BACKGROUND

Oven appliances generally include a control assembly that may house control components of the oven appliance. The control components may be electrical components that are configured to control, or may facilitate control, of the oven appliance. For example, the control components of the oven appliance may be, but are not limited to, control boards, wires, and switches. In some instances, the control assembly may define an opening at the rear of the oven appliance that may be used to access control components housed within the control assembly. For example, the opening may allow an operator of the oven appliance to access the control components during installation and/or maintenance of the oven appliance.

Additionally, the oven appliance may include a rear wire cover that is connected to the control assembly to close the opening. The rear wire cover may be fastened to the control assembly, e.g., to secure the rear wire cover in place. Ideally, minimal fasteners may be used to fasten the rear wire cover to the control assembly to reduce part count, reduce cost, and increase factory efficiency. However, when minimal fasteners are used, the rear wire cover may deflect and/or bend when force is applied to it. For example, when an operator of the oven appliance presses the rear wire cover, the rear wire cover may deflect and/or bend relative to the control assembly. In another example, the rear wire cover may be pressed against a wall such that the rear wire cover may deflect and/or bend relative to the control assembly. Such deflection and/or bending may permit ingress of moisture, grease, particulate matter and/or other contaminants which may be deleterious to the control components housed within the control assembly.

Accordingly, improved bracing features for bracing the rear wire cover may be desired. In particular, bracing features which prevent deflection of the rear wire cover relative to a control assembly of the oven appliance when installed and which do not interfere with the rotation of the rear wire cover during assembly, would be advantageous.

BRIEF DESCRIPTION

Aspects and advantages of the invention will be set forth in part in the following description, or may be apparent from the description, or may be learned through practice of the invention.

In one exemplary embodiment, an oven appliance is provided. The oven appliance may define a lateral direction, a transverse direction, and a vertical direction. More particularly, the lateral direction, the transverse direction, and the vertical direction may be mutually perpendicular. Further, the oven appliance may include a cabinet that extends between a top side and a bottom side along the vertical direction. In addition, the cabinet may extend between a front side and a back side along the transverse direction. The oven appliance additionally includes a control assembly positioned at the top side and the back side of the cabinet. Further, the oven appliance includes a rear wire cover connected to the control assembly. More particularly, the rear wire cover is rotatable between an open position and a closed position. The oven appliance additionally includes one or more control brackets attached to the control assembly. Each of the control brackets further includes a brace.

In another exemplary embodiment, an oven appliance is provided. The oven appliance may include a cabinet defining a top side and a back side. Further, the oven appliance may include a control assembly positioned at the top side and the back side of the cabinet. The oven appliance additionally includes a rear wire cover connected to the control assembly. Further, the oven appliance includes a control bracket attached to the control assembly. More particularly, the control bracket includes a brace.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 7 is a cross sectional side view of a control assembly of an oven appliance in accordance with one or more exemplary embodiments of the present disclosure.

Figure 1:
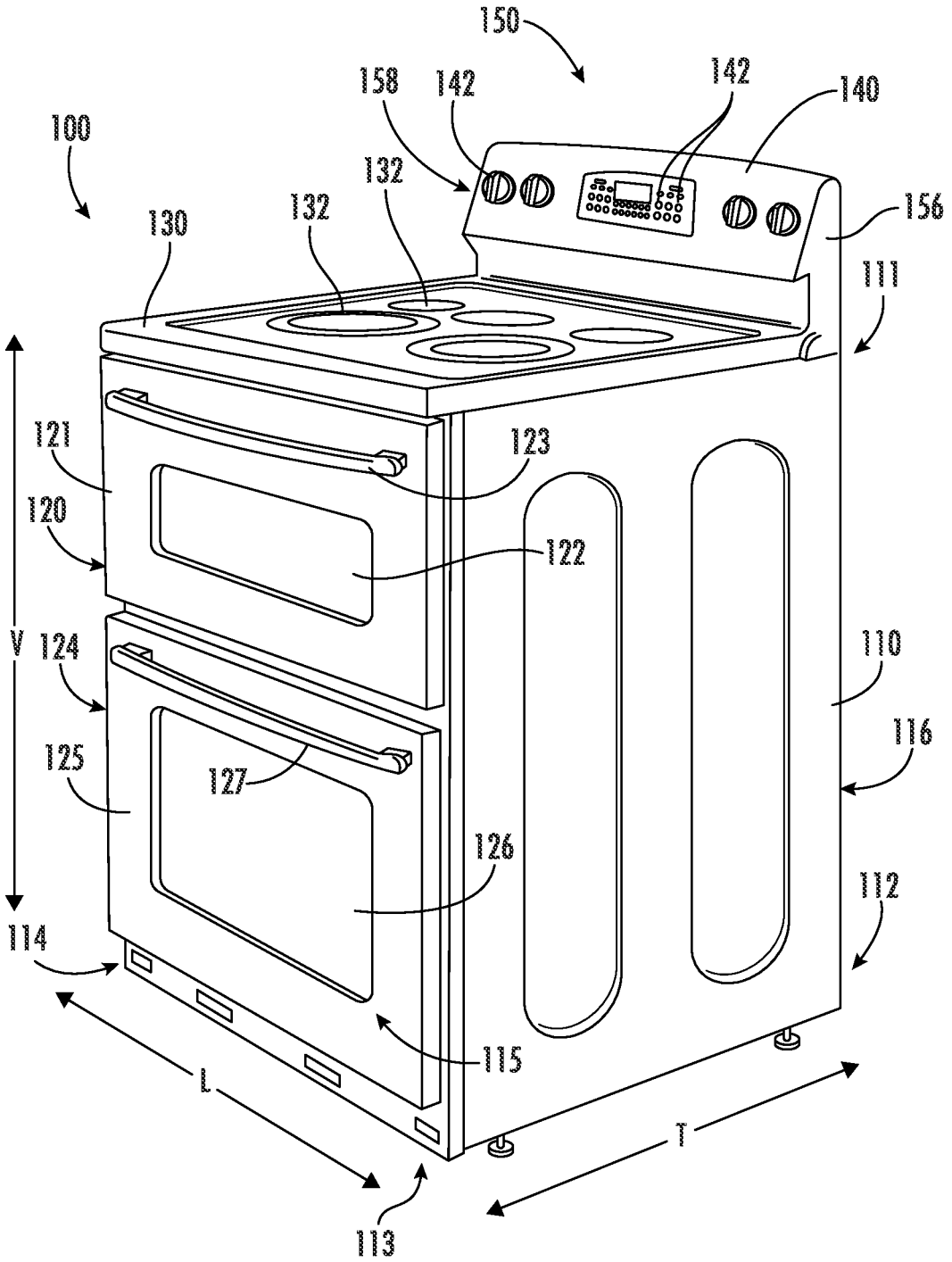
FIG. 1 is a front perspective view of an oven appliance in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value. For example, the approximating language may refer to being within a ten percent margin.

Figure 2:
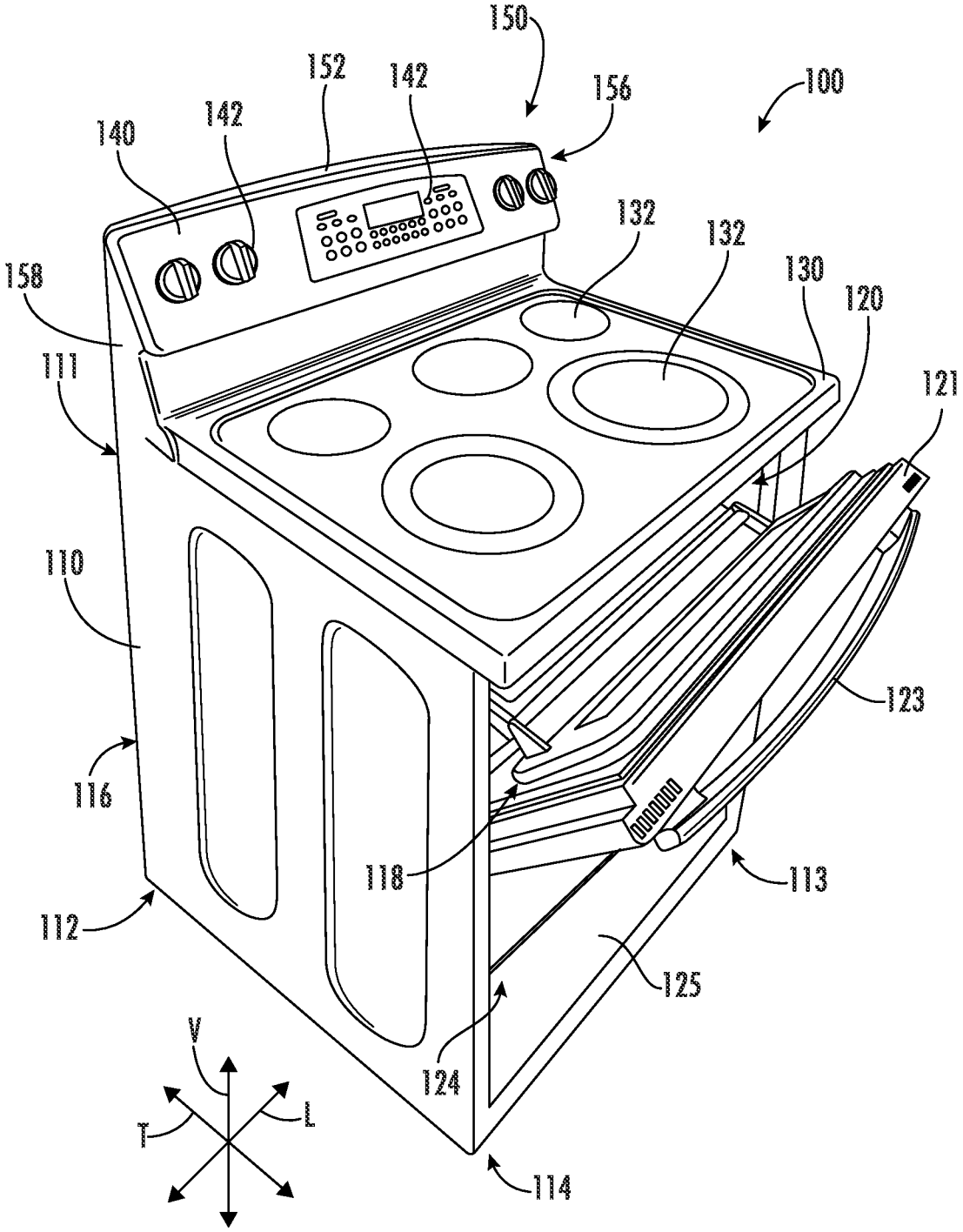
FIG. 2 is a perspective view of the oven appliance of FIG. 1 with a door of the oven appliance opened.
Figure 3:
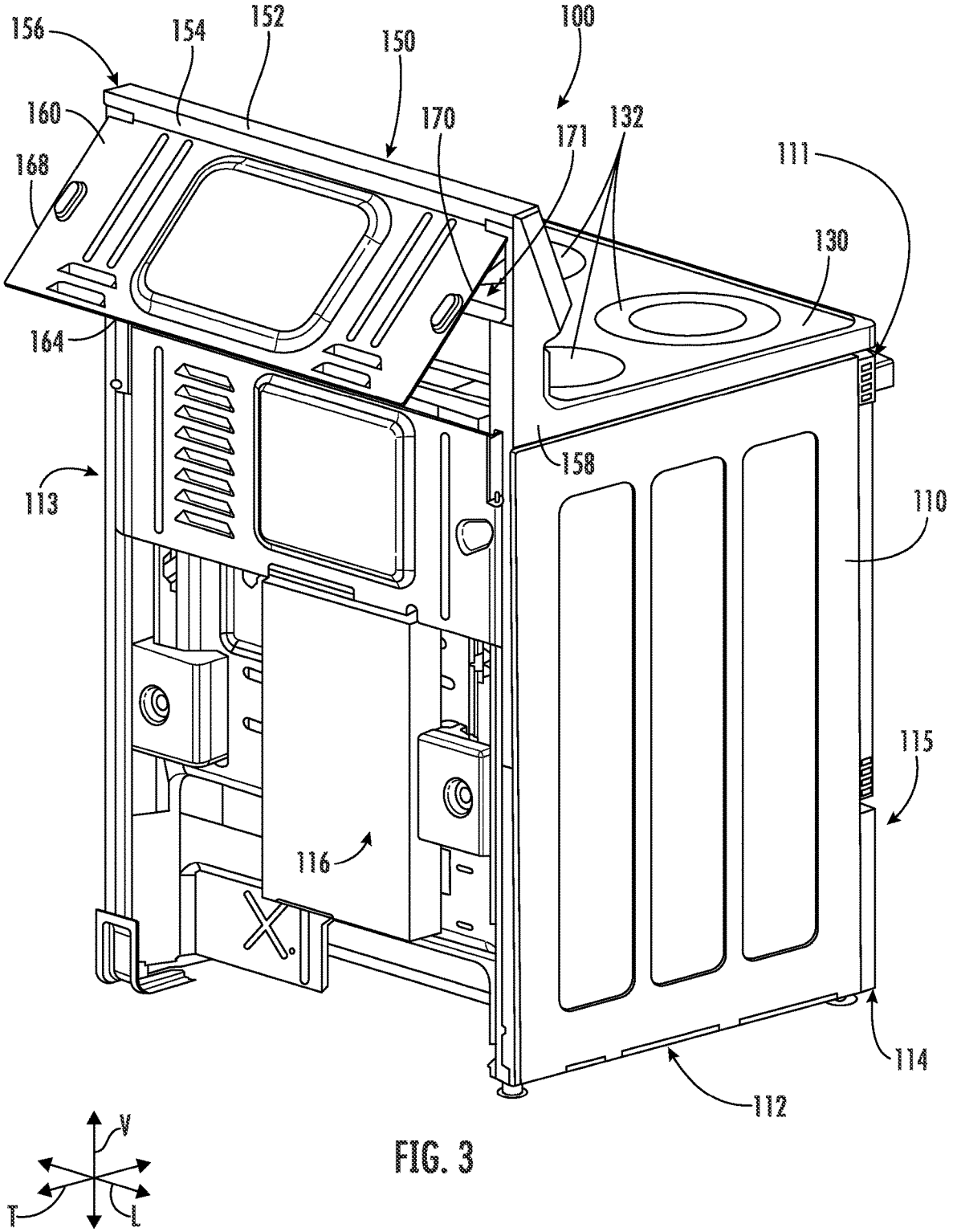
FIG. 3 is a rear perspective view of the oven appliance of FIG. 1, with a rear wire cover of the oven appliance in an open position.

Referring now to FIGS. 1 through 3, perspective views of an oven appliance 100 in accordance with exemplary embodiments of the present disclosure are provided. Oven appliance 100 defines a vertical direction V, a lateral direction L and a transverse direction T. The vertical direction V, the lateral direction L, and the transverse direction T being mutually perpendicular such as to form an orthogonal direction system.

Oven appliance 100 may include an insulated cabinet 110. Cabinet 110 may extend between a top side 111 and a bottom side 112, e.g., along the vertical direction V. Thus, top side 111 and bottom side 112 of cabinet 110 may be spaced apart from each other, e.g., along the vertical direction V. Cabinet 110 may also extend between a first side 113 and a second side 114, e.g., along the lateral direction L. Thus, the first side 113 and the second side 114 of cabinet 110 may be spaced apart from each other, e.g., along the lateral direction L. Cabinet 110 may further extend between a front side 115 and a back side 116, e.g., along the transverse direction T. Thus, the front side 115 and the back side 116 of cabinet 110 may be spaced apart from each other, e.g., along the transverse direction T.

Oven appliance 100 may include a cooktop 130 positioned at or adjacent top side 111 of cabinet 110. Cooktop 130 may include various heating elements 132, such as gas burners, electric resistance elements, induction elements, etc., that are configured for heating cookware positioned on or above the heating elements 132. As may be seen in FIG. 1, cabinet 110 may also define an upper cooking chamber 120 and a lower cooking chamber 124. Thus, oven appliance 100 may be referred to as a double oven range appliance.

As will be understood by those skilled in the art, oven appliance 100 is provided by way of example only, and the present subject matter may be used in any suitable oven appliance, e.g., a single oven range appliance, a single wall oven appliance, a double wall oven appliance, etc.

Upper cooking chamber 120 may be positioned at or adjacent top side 111 of cabinet 110. Conversely, lower cooking chamber 124 may be positioned at or adjacent bottom side 112 of cabinet 110. Thus, upper cooking chamber 120 and lower cooking chambers 124 may be spaced apart from each other along the vertical direction V. Upper cooking chamber 120 and lower cooking chamber 124 may have any suitable size relative to each other. For example, as shown in FIG. 1, upper cooking chamber 120 may be smaller than lower cooking chamber 124.

Upper cooking chamber 120 and lower cooking chamber 124 may be configured for receipt of one or more food items to be cooked. Oven appliance 100 may include an upper door 121 and a lower door 125 that are attached or coupled to cabinet 110, e.g., with slide assemblies and/or hinges, etc., in order to permit selective access to upper cooking chamber 120 and lower cooking chamber 124, respectively. Handles 123, 127 may be mounted to upper door 121 and lower doors 125, respectively, to assist a user with opening and closing upper door 121 and lower door 125 in order to access the lower cooking chamber 124 and the upper cooking chamber 124. As an example, a user may pull on handle 123 mounted to upper door 121 to open or close upper door 121 and access upper cooking chamber 120. Glass window panes 122, 126 provide for viewing the contents of upper cooking chamber 120 and lower cooking chamber 124 when upper door 121 and lower door 125 are closed and also assist with insulating upper cooking chamber 120 and lower cooking chamber 124. Heating elements such as electric resistance heating elements, gas burners, microwave elements, etc., may be positioned within upper cooking chamber 120 and lower cooking chamber 124 of cabinet 110 for heating upper cooking chamber 120 and lower cooking chamber 124, respectively.

As may be seen in FIG. 2, cabinet 110 may define an opening 118 for accessing upper cooking chamber 120 of cabinet 110. Upper door 121 may be positioned at or adjacent opening 118 of cabinet 110 when upper door 121 is in the closed position. Conversely, at least a portion of upper door 121 may be spaced apart from cabinet 110, e.g., opening 118 of cabinet 110, along the transverse direction T when upper door 121 is in the open position.

When upper door 121 is in the closed position as shown in FIG. 1, upper door 121 seals or closes upper cooking chamber 120. Thus, such position and orientation of upper door 121 may be used when cooking food items within upper cooking chamber 120. If a user wants to check on the food items, the user may open upper door 121 (as illustrated in FIG. 2) in order to allow the user to view and observe the food items within upper cooking chamber 120.

Oven appliance 100 may additionally include a control assembly 150 that may be positioned at a top side, e.g., at or adjacent to top side 111, and at a back side, e.g., at or adjacent to back side 116, of cabinet 110. Control assembly 150 may extend from the top side 111 of the cabinet 110 to a top panel 152 of the control assembly 150, e.g., along the vertical direction V. Thus, the top panel 152 of the control assembly 150 and the top side 111 of the cabinet 110 may be spaced apart, e.g., along the vertical direction V. The control assembly 150 may generally extend between a control panel 140 and a rear panel 154, e.g., along the transverse direction T. Thus, the control panel 140 and the rear panel 154 may be spaced apart from each other, e.g., along the transverse direction T. Control assembly 150 may additionally extend between a first side panel 156 and a second side panel 158, e.g., along the lateral direction L. Thus, the first side panel 156 and the second side panel 158 may be spaced apart from each other, e.g., along the lateral direction L.

In some embodiments, control panel 140 may provide selections for user manipulation of the operation of oven appliance 100. For example, one or more user inputs 142 may be provided on, e.g., mounted to, the control panel 140. The user inputs 142 may include multiple of the same type of inputs, e.g., multiple knobs, buttons, and/or switches, and/or may include various types of inputs, such as multiple knobs and a touchpad interface, e.g., as illustrated in FIGS. 1 and 2. In response to user manipulation of user inputs 142, various components of the oven appliance 100, such as the heating elements, may be operated.

Figure 4:
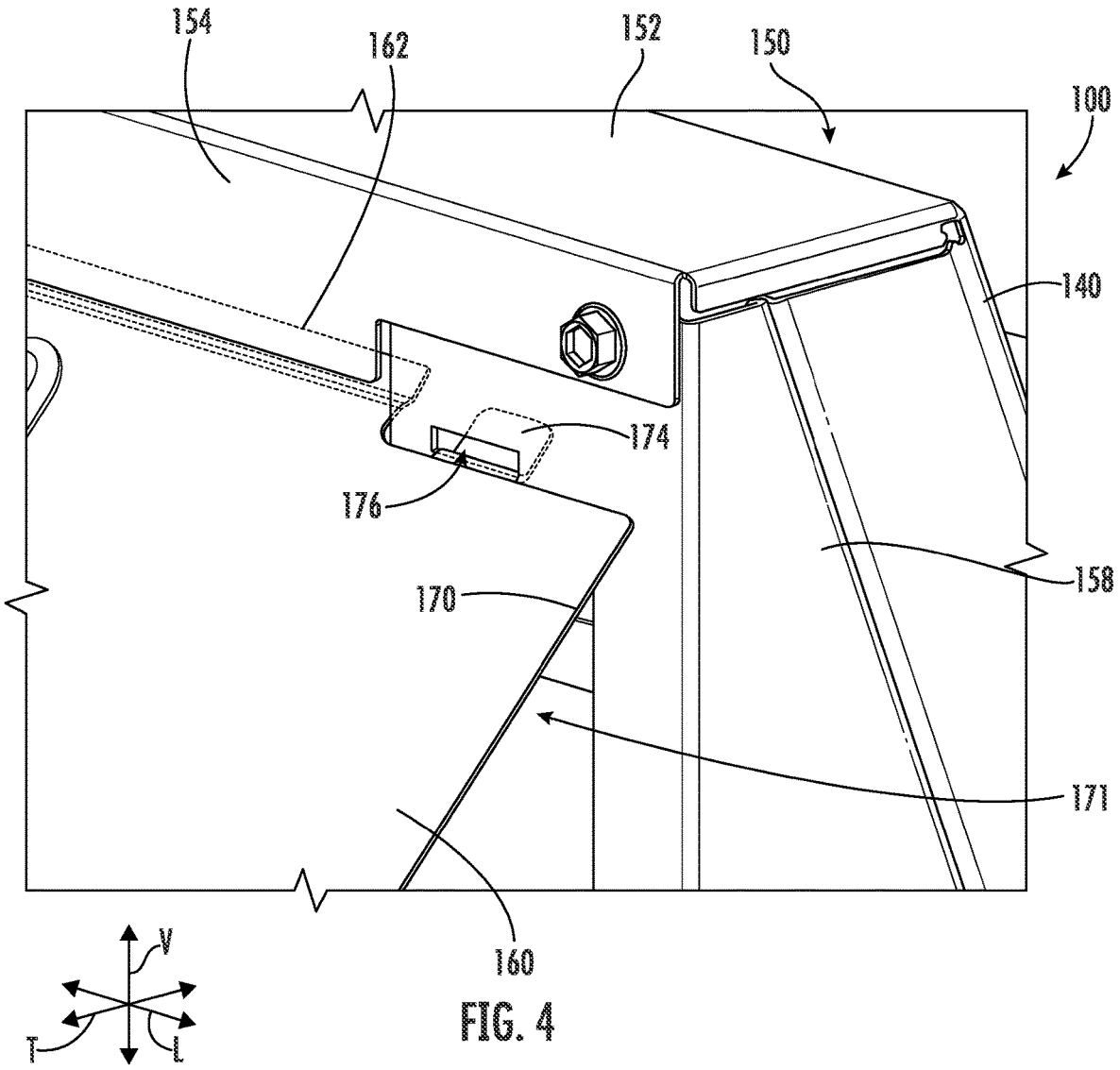
FIG. 4 is a close-up perspective view of a portion of the oven appliance of FIG. 3.
Figure 5:
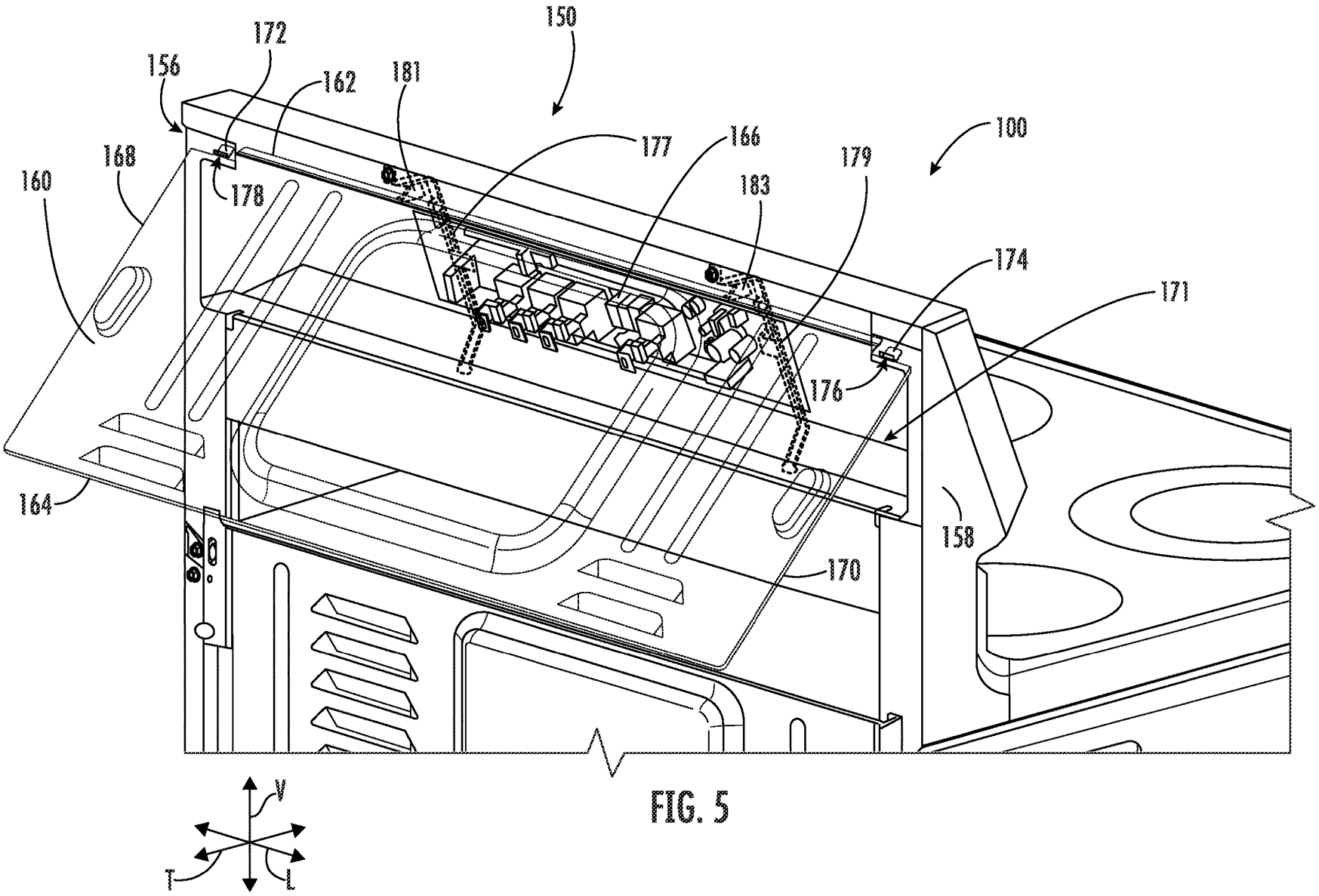
FIG. 5 is a close-up perspective view of another portion of the oven appliance of FIG. 3.

In some embodiments, e.g., as illustrated in FIGS. 3 through 5, control assembly 150 may define an opening 171 for accessing control components housed within the control assembly 150. For instance, in some embodiments (such as depicted in FIG. 5) the control assembly 150 may house a processing device or a controller 166 that may be generally configured to facilitate operation of oven appliance 100. In this regard, control panel 140 and/or user inputs 142 thereon may be in communication with controller 166 such that controller 166 may receive control inputs from user inputs 142 and may otherwise regulate operation of oven appliance 100. For example, signals generated by controller 166 may operate oven appliance 100, including any or all system components, subsystems, or interconnected devices, in response to the position of user input 142 and other control commands. Control panel 140 and other components of oven appliance 100 may be in communication with controller 166 via, for example, one or more signal lines or shared communication buses. In this manner, Input/Output ("I/O") signals may be routed between controller 166 and various operational components of oven appliance 100.

As will be understood by those skilled in the art, the present control assembly 150 is provided by way of example only, and in alternative exemplary embodiments, the control assembly 150 may be configured in any suitable manner. For example, in some embodiments, the shape of the control assembly 150 may be different, the user inputs 142 may be digital user inputs, e.g., provided on a touchscreen interface, or the components of the control assembly may be integrally formed, among other possible variations that will be apparent to those of ordinary skill in the art.

The oven appliance 100 may include a rear wire cover 160 that may be connected to the control assembly 150. In addition, when connected to the control assembly 150, rear wire cover 160 may be rotatable relative to the control assembly 150 to open and close the opening 171. For example, the rear wire cover 160 may be rotatable between an open position, e.g., a position where the opening 171 may be unobstructed or at most partially obstructed or partially occluded such that an interior of the control assembly 150 may be accessible through the opening 171, and a closed position, e.g., a position where the opening 171 may be closed by the rear wire cover 160 such that the control assembly 150, e.g., the interior thereof, may be fully enclosed and may be inaccessible.

In addition, it should be appreciated that when in the closed position, the rear wire cover 160 may be oriented parallel to, or approximately parallel to, the vertical direction V. Further, in the closed position, the control assembly 150 and the rear wire cover 160 may form an electrical enclosure for the control components, such as controller 166, housed within the interior of the control assembly 150. In addition, the rear wire cover 160 may be fastened to the control assembly 150 such that the rear wire cover 160 may be secured to the control assembly in the closed position.

In some embodiments, e.g., as illustrated in FIGS. 3 through 5, the rear wire cover 160 may have a rectangular shape and may generally extend between a top edge 162 and a bottom edge 164, e.g., along the vertical direction V when the rear wire cover 160 is in the closed position. In addition, the rear wire cover 160 may generally extend between a first edge 168 and a second edge 170, e.g., along the lateral direction L when the rear wire cover 160 is in the closed position. In some embodiments, e.g., FIGS. 3 through 5, the rear wire cover 160 may include one or more rotation hooks, such as a first rotation hook 172 and a second rotation hook 174. The first rotation hook 172 may be positioned proximate the top edge 162 and the first edge 168 and the second rotation hook 174 may be positioned proximate the top edge 162 and the second edge 170.

In additional embodiments, only one rotation hook may be provided, or more than two rotation hooks may be provided, e.g., three or more rotation hooks may be provided, such as a third rotation hook equidistant along the lateral direction L between the exemplary first and second rotation hooks shown and described herein.

Together the first rotation hook 172 and the second rotation hook 174 may facilitate rotation of the rear wire cover 160 relative to the control assembly 150. For instance, in some embodiments, the first rotation hook 172 may be inserted into the first side panel 156 and the second rotation hook 174 may be inserted into the second side panel 158. For example, during assembly of the oven appliance 100, an operator of the oven appliance 100 may insert the first rotation hook 172 in the first side panel 156 and insert the second rotation hook 174 into the second side panel 158, such that the rear wire cover 160 is in the open position, e.g., as depicted in FIG. 3. From the open position, the rear wire cover 160 may be rotatably to the closed position, e.g., by rotating the rear wire cover 160 relative to the control assembly 150, e.g., at the first rotation hook 172 and the second rotation hook 174.

In the closed position, the first rotation hook 172 and the second rotation hook 174 may hook into the first side panel 156 and the second side panel 158, respectively, such that the rear wire cover 160 may be freestanding in the closed position, e.g., the rear wire cover 160 may not need physical support, such as support from an operator of the oven appliance 100, or mechanical support, such as support from a fastener, to stay in the closed position.

As such, it should be appreciated that as used herein "hook" may refer the rear wire cover 160 interfacing with the control assembly 150, and specifically the first side panel 156 and the second side panel 158, such that in the closed position, the rear wire cover 160 may be freestanding. For example, the first rotation hook 172 and the second rotation hook 174 may catch on to, may be mounted on to, or may hang from, an inner surface of the control assembly 150 to support the weight of the rear wire cover 160 in the closed position.

Further, in the closed position, one or more fasteners, e.g., screws, bolts, rivets, etc., may be included for the security of the rear wire cover 160, e.g., in the closed position. During assembly of the oven appliance 100, the freestanding nature of the rear wire cover 160 may allow for an operator of the oven appliance 100 to secure the rear wire cover 160 to the oven appliance 100 without having to physically support or hold the rear wire cover 160 in the closed position. This may allow for improved ergonomics for an operator of the oven appliance 100 as the operator may be capable of securing the rear wire cover 160 to the oven appliance 100, e.g., by tightening the one or more fasteners, without having to hold the rear wire cover 160 in place.

One of ordinary skill in the art would understand that the one or more rotation hooks provided at the rear wire cover 160, e.g., as depicted in FIGS. 3 through 5, is provided by way of example only, and in additional embodiment, the first side panel 156 and the second side panel 158 may include the one or more rotation hooks while the rear wire cover 160 includes one or more slots configured to receive the one or more rotation hooks. In such embodiments, the one or more rotation hooks of the first side panel 156 and the second side panel 158 may support the rear wire cover 160 such that the rear wire cover may be freestanding in the closed position.

Referring now briefly to FIG. 4, a close-up perspective view of the control assembly 150 and the rear wire cover 160 is provided. As mentioned above, in some embodiments, one or more rotation hooks, e.g., the first rotation hook 172 and the second rotation hook 174, of the rear wire cover 160 may be inserted into the control assembly 150 to facilitate rotation of the rear wire cover 160 relative to the control assembly 150. In particular, the first rotation hook 172 may be inserted into a slot 178 defined by the first side panel 156, and similarly, the second rotation hook 174 may be inserted into a slot 176 defined by the second side panel 158. It should be appreciated that for clarity and brevity, FIG. 4 depicts only the second rotation hook 174 inserted into the second side panel 158. As will be understood by those skilled in the art, the first rotation hook 172 may similarly be inserted into the slot 178 defined by the first side panel 156 of the control assembly 150. Additionally, in some embodiments, such as depicted in FIG. 4, the top edge 162 of the rear wire cover 160 may be positioned within the control assembly 150 and may rotate within the control assembly 150.

Referring now to FIG. 5, a close-up perspective view of the oven appliance 100 with the rear wire cover 160 in the open position is provided. In particular, as depicted in FIG. 5, the rear wire cover 160 is depicted in phantom as to reveal the control components, e.g., controller 166, housed within the control assembly 150. In addition, the control components may generally be mounted to one or more control brackets attached to the control assembly.

Figure 6:
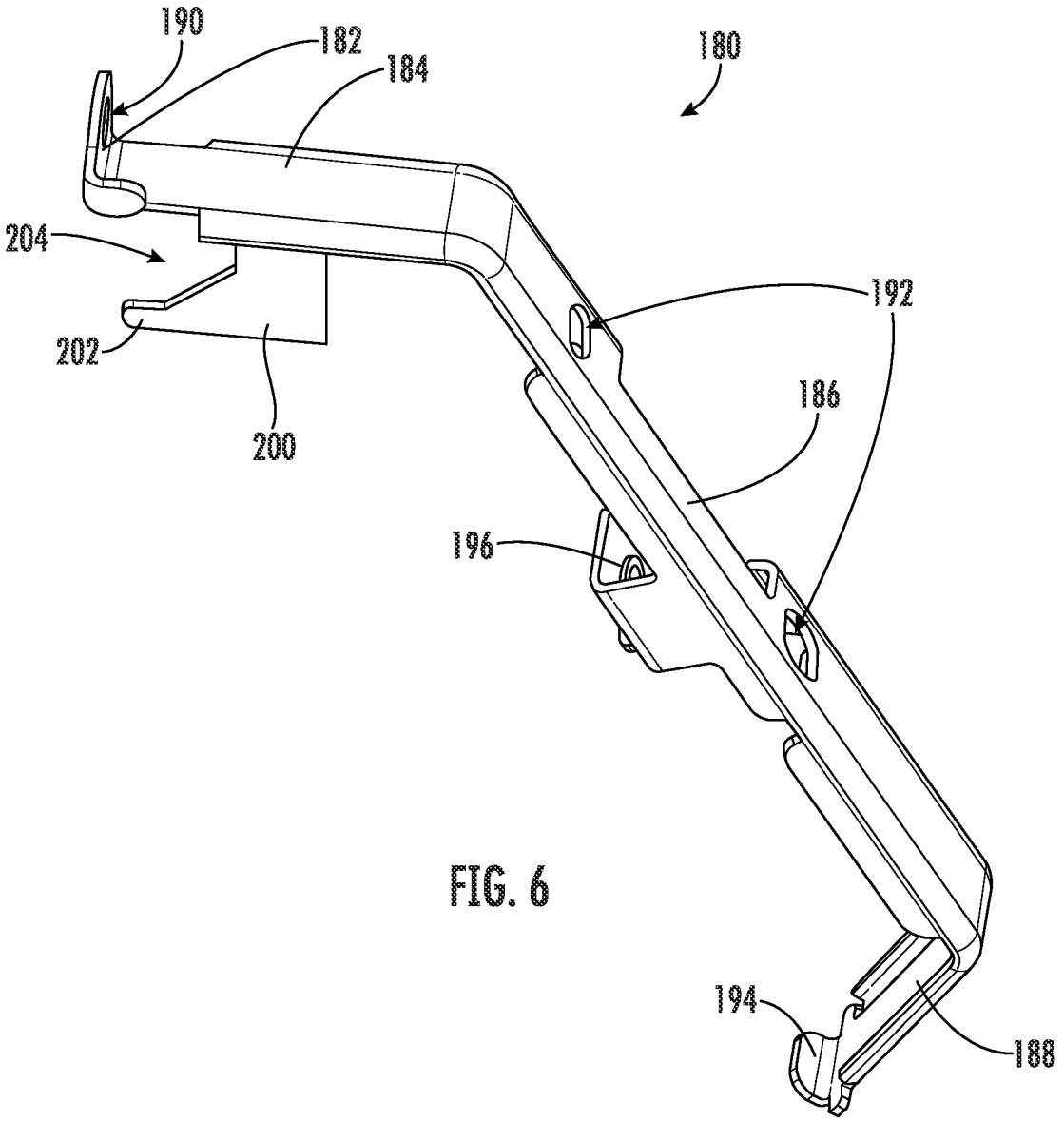
FIG. 6 is a perspective view of a control bracket which may be incorporated into an oven appliance such as the exemplary oven appliance of FIG. 1 in accordance with one or more exemplary embodiments of the present disclosure.

An exemplary perspective view of a control bracket 180 in accordance with one or more exemplary aspects of the present embodiment is provided in FIG. 6. In some embodiments, the control bracket 180 may include a rear portion 182, a top portion 184, a panel portion 186, and a bottom portion 188 that together may generally define the shape of the control bracket 180. In addition, in some embodiments, the rear portion 182 may define a rear attachment hole 190, the panel portion 186 may define a plurality of panel attachment holes or slots 192, and the bottom portion 188 may include a latch 194.

Generally, the control bracket 180 may be shaped such that the control bracket 180 may generally align with the inner contours of the control assembly 150. Particularly, in some embodiments, the control bracket 180 may be shaped such that various portions of the control bracket 180 may be approximately parallel to respective portions of the control assembly 150 when the control bracket 180 is attached thereto. For example, in some embodiments, the rear portion 182 may be approximately parallel to the rear panel 154 of the control assembly 150, the top portion 184 may be approximately parallel to the top panel 152 of the control assembly, and the panel portion 186 may be approximately parallel to the control panel 140 of the control assembly 150.

It should be appreciated that the shape of the control bracket 180 depicted in FIG. 6 is provided by way of example only, and in alternative exemplary embodiments, the control bracket 180 may be any suitable shape that may generally align with the inner contours of the control assembly 150.

Moreover, in some embodiments, the control bracket 180 may be formed from a single sheet metal piece. In such embodiments, the rear portion 182, the top portion 184, the panel portion 186, and the bottom portion 188 may be integrally formed such that the control bracket 180 is a single monolithic piece. Those of ordinary skill in the art will recognize that in some embodiments the rear portion 182, the top portion 184, the panel portion 186, and the bottom portion 188 may be separate pieces that may be coupled to one another, respectively.

As mentioned, the control bracket 180 may include a metal material, e.g., sheet metal. It should be appreciated that the material of the control bracket 180 is provided by way of example only. In various exemplary embodiments, the control bracket 180 may include any suitable material. For example, in some embodiments, the control bracket 180 may be formed from metal materials such as stainless steel, aluminum, and/or carbon steel. As another example, in additional embodiments, the control bracket 180 may be formed from any suitable plastic materials, such ABS plastic or heat resistant plastic materials.

As mentioned above, the control components, such as the controller 166, of the oven appliance 100 may be mounted, e.g., to one or more control brackets 180. As such, control bracket 180 may include features that may be used to mount the control components to control bracket 180. For example, control bracket 180 includes a mount 196 that may be used to mount the control components, such as controller 166, to control bracket 180. Additionally, the control bracket 180 may attach to the control assembly 150. In particular, the rear attachment hole 190 of the control bracket 180 may be used to attach the control bracket 180 to the rear panel 154 of the control assembly 150. The plurality of panel attachment holes or slots 192 may be used to attach the control bracket 180 to the control panel 140 of the control assembly 150. The latch 194 of the bottom portion 188 may be used to attach, e.g., latch, the control bracket 180 to the control assembly 150.

Additionally, in some embodiments, a brace 200 of the oven appliance 100 may be attached to the control bracket 180. In some embodiments, the brace 200 may include a tab 202 and may define a notch 204. In particular, the brace 200 may be configured to brace, stabilize, buttress, and/or reinforce the rear wire cover 160 when the rear wire cover 160 is in the closed position. As such, the term "brace" (when used as a verb, and including cognates thereof such as "bracing") herein refers to the brace 200 supporting the rear wire cover 160, and more particularly, the top edge 162 of the rear wire cover 160, in the closed position such that the top edge 162 of the rear wire cover 160 may be prevented or inhibited from deflecting or bending relative to the rear panel 154 of the control assembly 150.

Additionally, in some embodiments the brace 200 may be formed integrally with the control bracket 180, e.g., as depicted in FIG. 6. For example, in some embodiments, the control bracket 180 and the brace 200 may be formed from a single piece of sheet metal. However, it should be appreciated that in alternative exemplary embodiments, the brace 200 may be coupled to the control bracket 180. For example, in such embodiments, the brace 200 may be joined to the control bracket 180 by any suitable method, such as via fasteners, e.g., bolts, screws, or rivets, or by welding, etc.

Referring now back to FIG. 5, the oven appliance 100 may include a first control bracket 177 having a first brace 181 attached thereto and a second control bracket 179 having a second brace 183 attached thereto. Together, the first control bracket 177 and the second control bracket 179 may mount the control components of the oven appliance. As depicted in FIG. 5, controller 166 is mounted to the first control bracket 177 and the second control bracket 179. It should be appreciated that the first control bracket 177 and the second control bracket 179 may be configured in a substantially similar manner as the control bracket 180 described in detail above in reference to FIG. 6. Additionally, it should be appreciated that the first brace 181 and the second brace 183 may be configured in a substantially similar manner as the brace 200 described in detail above in reference to FIG. 6

Figure 8:
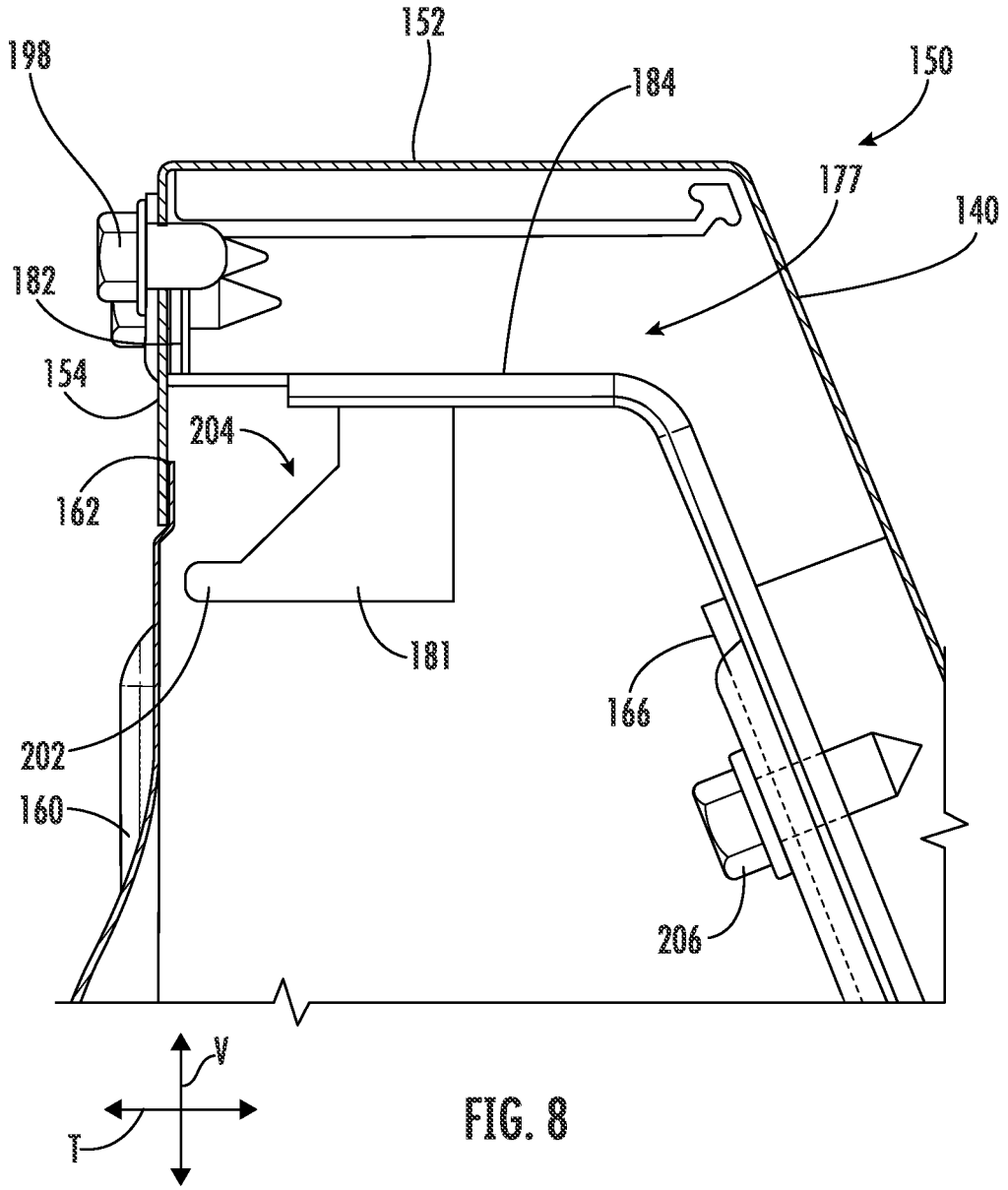
FIG. 8 is a cross sectional side view of a control assembly of an oven appliance in accordance with one or more exemplary embodiments of the present disclosure.

Referring now to FIGS. 7 and 8, close-up cross-sectional side views of the oven appliance 100 in accordance with one or more embodiments of the present disclosure are provided. In particular, FIG. 7 depicts the rear wire cover 160 in the open position and FIG. 8 depicts the rear wire cover 160 in the closed position. Furthermore, in some embodiments, the first brace 181 may be attached to first control bracket 177. It should be appreciated that the notch 204 defined by the first brace 181 may be shaped such that the notch 204 allows the rear wire cover 160 to rotate between the open position and the closed position, e.g., as depicted in FIGS. 7 and 8, respectively. In some embodiments, notch 204 may be shaped such that the top edge 162 may rotate with approximately no contact with the first brace 181. For example, as depicted in FIG. 7, the rear wire cover 160 may have approximately no contact with the first brace 181 when the rear wire cover 160 rotates between the open position and the closed position. Additionally, it should be understood that a tab 202 of the first brace 181 is positioned such that when the rear wire cover 160 is in the closed position, e.g., as depicted in FIG. 8, and a force is applied to the rear wire cover 160, the first brace 181 may brace the rear wire cover 160, e.g., the brace may contact an internal surface of the rear wire cover 160, such as the tab 202 of the first brace 181 may contact the internal surface, whereby the rear wire cover 160 is prevented or limited from travelling inward (towards or into the interior of the control assembly 150) and/or forwards (towards the front side 115 of the cabinet 110 of the oven appliance 100). Further, as depicted in FIG. 7, the first control bracket 177 may be attached to the control assembly 150. For example, as shown, the rear portion 182 of the first control bracket 177 may be attached to the rear panel 154 of the control assembly 150 with rivets 198. Moreover, as may be seen in FIG. 7, the controller 166 may be mounted to the control bracket 177 by mechanical fasteners 206. The mechanical fasteners 206 may be any suitable fastener, such as screws, rivets, or other similar fasteners.

It should be appreciated that the rear portion 182 may be attached to the rear panel 154 by any suitable attachment feature. For example, in some embodiments, the rear portion 182 may be attached by screws or bolts. Additionally, it should be appreciated that the controller 166 may be mounted to the control bracket 177 by any suitable fastener. For example, the control board may be mounted with screws or bolts.

Figure 9:
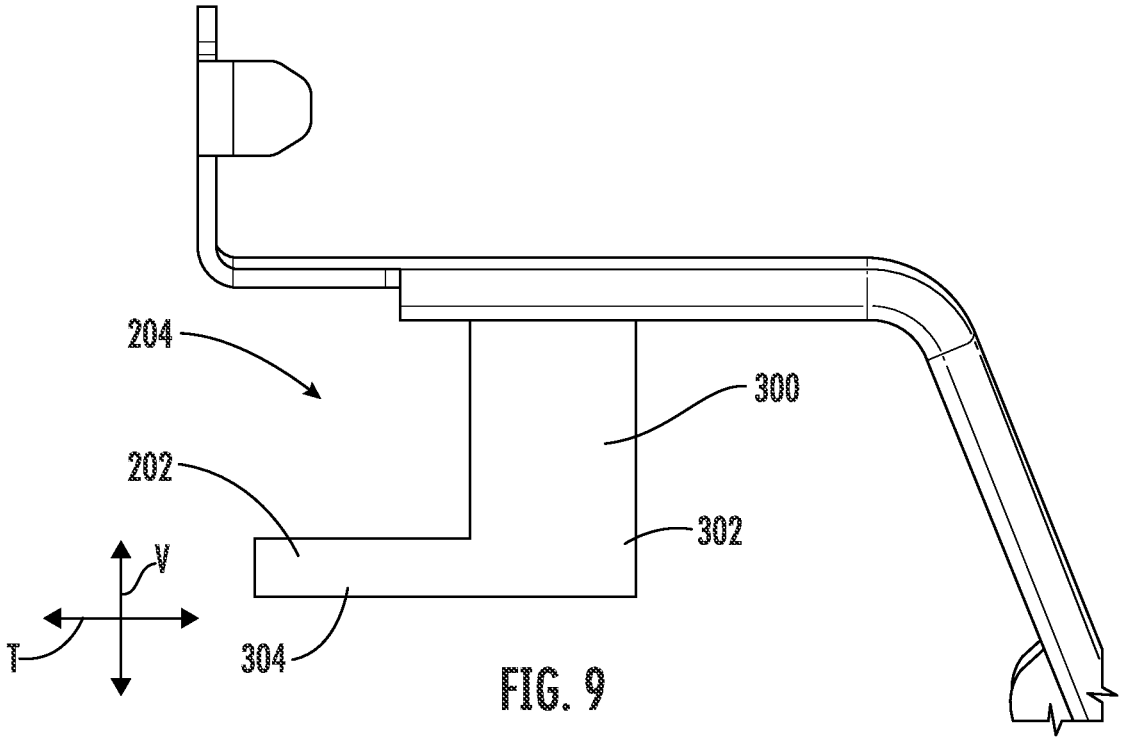
FIG. 9 is a side view of a brace in accordance with one or more exemplary embodiments of the present disclosure.
Figure 10:
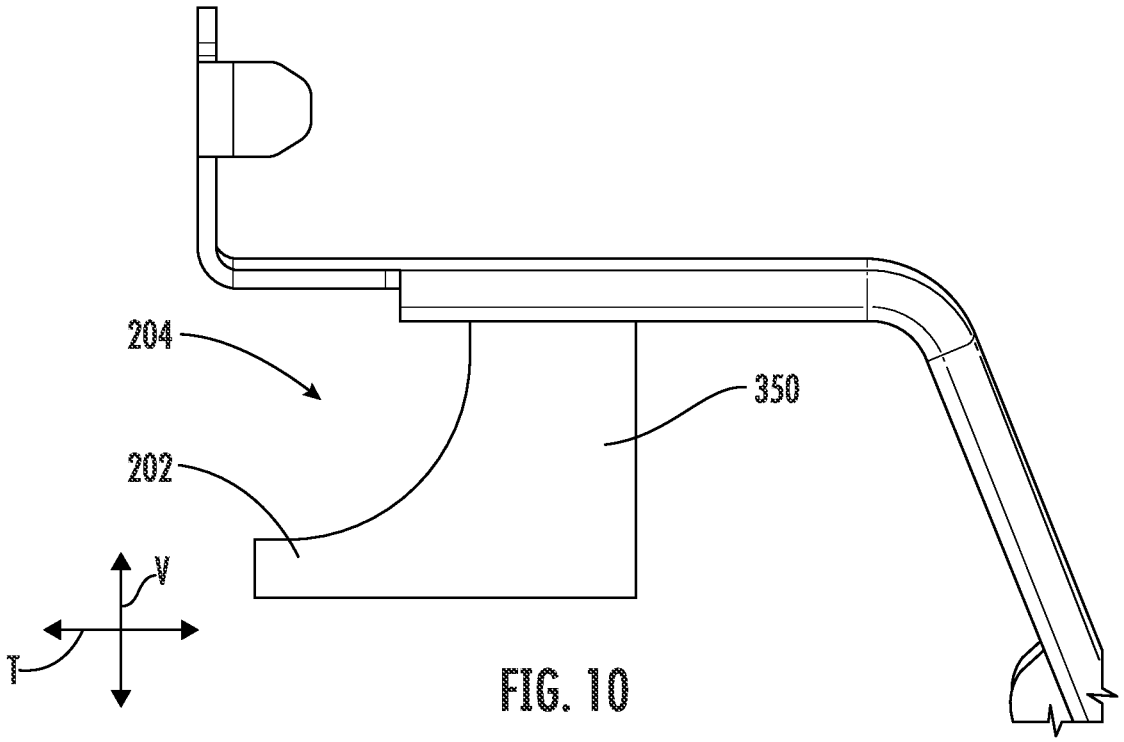
FIG. 10 is a side view of a brace in accordance with one or more additional exemplary embodiments of the present disclosure.

Referring now to FIGS. 9 and 10, side views of braces 300 and 350 are provided. It should be appreciated that braces 300, 350 are embodiments of the brace 200 described above. As such, the exemplary braces 300 and 350 of FIGS. 8 and 9 may be configured in substantially the same manner as the exemplary brace 200 of FIG. 5, and accordingly, the same or similar numbers may refer to the same or similar parts. In various embodiments, either brace 300 or 350 may be provided alone or in combination with any other brace 200, 300, or 350. For example, in embodiments where multiple control brackets are provided, e.g., two control brackets such as in the exemplary embodiment illustrated in FIG. 5, each control bracket may include a brace, and the braces of each respective control bracket may be the same as or different from the brace of one or more other control brackets.

For example, the exemplary braces 300 and 350 of FIGS. 9 and 10 each include a tab 202 and a notch 204. In some exemplary embodiments, e.g., as illustrated in FIG. 9, the brace 300 may be L-shaped. In particular, the brace 300 may include a first brace member 302 and a second brace member 304 that are approximately perpendicular to each other, e.g. to form the L-shape. For instance, the first brace member 302 may extend downward approximately along the vertical direction V, e.g., when incorporated into an oven appliance, such as oven appliance 100. Further, the second brace member 304 may extend from the first brace member 302 outward approximately along the transverse direction T, e.g., when incorporated into an oven appliance, such as oven appliance 100, to form an approximately ninety degree angle. It should be appreciated that the L-shaped brace 300 formed by the first brace member 302 and the second brace member 304 may allow for the rotation of a rear wire cover, such as rear wire cover 160, between an open and a closed position.

In additional exemplary embodiments, e.g., as illustrated in FIG. 10, the brace 350 may have a curved shape notch 204. For instance, the notch 204 may be shaped as a circular arc, an elliptical arc, or any other suitable arc which subtends a central angle of about ninety degrees. It should be appreciated that the curved shaped brace 350 may allow for the rotation of a rear wire cover, such as rear wire cover 160, between an open and a closed position.

The several embodiments of the present disclosure provide numerous advantages. For example, but without limitation, the exemplary oven appliance may provide a physical bracing feature to prevent deflection of the rear wire cover of the oven appliance. As another example, the exemplary oven appliance may create a safer environment for a user of the oven appliance and the electrical components housed within the oven appliance. Additionally, the exemplary oven appliance may provide time and or cost savings, e.g., in embodiments where the brace and the control bracket are integrally formed, such as from a single piece of sheet metal. As another example, the exemplary oven appliance may improve assembly and service of the oven appliance as the rear wire cover may be freestanding in the open position. Accordingly, by providing a physical brace, the oven appliance may be safer and allow for improved, e.g., easier, assembly and service.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance defining a lateral direction, a transverse direction, and a vertical direction, the lateral direction, the transverse direction, and the vertical direction being mutually perpendicular, the oven appliance comprising:

a cabinet extending between a top side and a bottom side along the vertical direction, and extending between a front side and a back side along the transverse direction;

a control assembly positioned at the top side and at the back side of the cabinet, the control assembly comprising a control panel, a top panel, and a rear panel;

a rear wire cover connected to the control assembly, the rear wire cover rotatable between an open position and a closed position; and one or more control brackets attached to the control assembly, each of the one or more control brackets comprising a rear portion attached directly to the rear panel of the control assembly, a top portion extending parallel to the top panel of the control assembly, a panel portion extending parallel to the control panel, and a brace attached to the top portion of the respective control bracket of the one or more control brackets, wherein each brace defines a notch that is configured to allow the rear wire cover to rotate between the open position and the closed position.

2. The oven appliance of claim 1, wherein each brace comprises a tab that is engageable with the rear wire cover to brace the rear wire cover when the rear wire cover is in the closed position.

3. The oven appliance of claim 1, wherein each brace is formed integrally with a respective control bracket of the one or more control brackets.

4. The oven appliance of claim 1, wherein each brace is coupled to a respective control bracket of the one or more control brackets.

5. The oven appliance of claim 1, wherein the rear wire cover and the control assembly together form an electrical enclosure when the rear wire cover is in the closed position.

6. The oven appliance of claim 1, wherein the control assembly comprises a control board, and wherein the control board is mounted to the control assembly via the one or more control brackets.

7. The oven appliance of claim 1, wherein each brace is L-shaped or curved shaped.

8. The oven appliance of claim 1, wherein the rear wire cover is configured to be freestanding in the closed position.

9. An oven appliance comprising:

a cabinet defining a top side and a back side;

a control assembly positioned at the top side and the back side of the cabinet, the control assembly comprising a control panel, a top panel, and a rear panel;

a rear wire cover connected to the control assembly, wherein the rear wire cover is rotatable between an open position and a closed position; and a control bracket attached to the control assembly, the control bracket comprising a rear portion attached directly to the rear panel of the control assembly, a top portioning extending parallel to the control assembly, a panel portion extending parallel to the control panel, and a brace attached to the top portion of the control bracket, wherein the brace defines a notch that is configured to allow the rear wire cover to rotate between the open position and the closed position.

10. The oven appliance of claim 9, wherein the brace comprises a tab that is engageable with the rear wire cover to brace the rear wire cover when the rear wire cover is in the closed position.

11. The oven appliance of claim 9, wherein the rear wire cover and the control assembly form an electrical enclosure when the rear wire cover is in the closed position.

12. The oven appliance of claim 9, wherein the brace is formed integrally with the control bracket.

13. The oven appliance of claim 9, wherein the brace is coupled to the control bracket.

14. The oven appliance of claim 9, wherein the control assembly comprises a control board, and wherein the control board is mounted to the control assembly via the control bracket.

15. The oven appliance of claim 9, wherein the control bracket is a first control bracket comprising a first brace, and wherein the oven appliance further comprises a second control bracket comprising a second brace.

16. The oven appliance of claim 15, wherein the first brace and the second brace are configured to brace the rear wire cover.

* * * * *